US006974342B2

(12) United States Patent
Thomas

(10) Patent No.: US 6,974,342 B2
(45) Date of Patent: Dec. 13, 2005

(54) CONNECTOR ELEMENTS INCLUDING PROTECTIVE MEMBER FOR PREVENTING CONNECTION TO CERTAIN CONNECTOR ELEMENTS

(75) Inventor: William J. Thomas, Dakota Dunes, SD (US)

(73) Assignee: Gateway Inc., Irvine, CA (US)

( * ) Notice: Subject to any disclaimer, the term of this patent is extended or adjusted under 35 U.S.C. 154(b) by 0 days.

(21) Appl. No.: 10/837,966

(22) Filed: May 3, 2004

(65) Prior Publication Data

US 2005/0245116 A1 Nov. 3, 2005

(51) Int. Cl.[7] ..... H01R 27/00
(52) U.S. Cl. ..... 439/222; 439/681; 439/956
(58) Field of Search ..... 439/170, 221–224, 439/679, 177, 217, 518, 681, 175, 166, 956

(56) References Cited

U.S. PATENT DOCUMENTS

| | | | | |
|---|---|---|---|---|
| 3,120,985 | A * | 2/1964 | Hubbell | 439/166 |
| 4,386,333 | A * | 5/1983 | Dillan | 336/107 |
| 4,911,649 | A | 3/1990 | Helmich, Jr. | |
| 5,118,301 | A | 6/1992 | Bentivolio | |
| 5,973,948 | A | 10/1999 | Hahn et al. | |
| 6,087,741 | A | 7/2000 | Baberg | |
| 6,223,296 | B1 | 4/2001 | Lin | |
| 6,227,883 | B1 * | 5/2001 | Lee et al. | 439/106 |
| 6,296,528 | B1 * | 10/2001 | Roberts et al. | 439/676 |
| 6,328,584 | B1 * | 12/2001 | Follett | 439/222 |
| 6,396,726 | B1 | 5/2002 | Austin et al. | |
| 6,411,119 | B1 | 6/2002 | Feldtkeller | |
| 6,512,682 | B2 | 1/2003 | Cohen et al. | |

OTHER PUBLICATIONS

Voltage selector assembly—Joy, EF, Weber, M., Wheeler, WR—IBM Technical Desclosure Bulletin—vol. 27, No. 3, Aug. 1984, PP 1726-7.
Units suit power needs around the world—Ormond, T.—EDN—vol. 34, No. 21, Oct. 12, 1989.

* cited by examiner

*Primary Examiner*—Hae Moon Hyeon
(74) *Attorney, Agent, or Firm*—Jeffrey A. Proehl; Leonard & Proehl, Prof. L.L.C

(57) ABSTRACT

An electrical device includes a power supply that is switchable between a first mode and a second mode. The power supply includes a first connector element of the power supply, the first connector element being one of a male and a female connector element for mating with a corresponding second connector element, the second connector element being one of a female and a male connector element, respectively. The power supply also includes a guard member disposed on the first connector element, the guard member being movable between a first position in which the first connector element is adapted to mate with any corresponding second connector elements and the power supply is in the first mode and a second position in which the first connector element is only adapted to mate with specially configured second connector elements and the power supply is in the second mode. The electrical device also includes electrical equipment powered through the power supply.

27 Claims, 3 Drawing Sheets

CONNECTOR ELEMENTS INCLUDING PROTECTIVE MEMBER FOR PREVENTING CONNECTION TO CERTAIN CONNECTOR ELEMENTS

BACKGROUND AND SUMMARY

The present invention relates to connector elements, such as those used with power supplies for personal computers and the like, and, more particularly, to connector elements that provide protection against connecting the connector elements to certain other connector elements, such as inadvertently connecting a 110V power supply connector element to a 220V power cord.

Power supplies such as are typically found in devices such as personal computers mostly presently use switcher technology to convert AC power input to lower DC voltages. For example, in personal computers, input AC power is usually either 110V, e.g., in the U.S., or 220V, e.g., in most European countries. The computer's digital circuits typically use 3.3V and 5V, and 12V is used to run motors in disk drives and fans.

Many power supplies are adapted to operate at either 110V or 220V. For example, an electrical device used in the U.S. operates with 110V AC input power. For some devices, if the user travels abroad and plugs the computer into 220V AC input power, internal circuitry will automatically accommodate the different input power. For other devices, the user manually operates a switch on the power supply so that the correct circuitry will be used depending upon what the input voltage is. The automatic circuitry tends to be more expensive than the manual switch.

If an electrical device that is set up to operate with 110V AC input voltage is plugged into 220V AC, the electrical device may be seriously damaged. Users of electrical devices having manual switches will often accidentally fail to set the switch on the device properly, often leading to damage of such devices. Accordingly, it is increasingly common for electrical devices to be provided with the internal circuitry necessary to automatically accommodate whatever type of power is input, adding to the cost of the devices. It is desirable to provide low cost protection against connection of electrical device power supplies to the wrong type of input power.

According to an aspect of the present invention, a power supply arrangement for an electrical device includes a power supply that is switchable between a first mode and a second mode, a first connector element of the power supply, the first connector element being one of a male and a female connector element for mating with a corresponding second connector element, the second connector element being one of a female and a male connector element, respectively, and a guard member disposed on the first connector element, the guard member being movable between a first position in which the first connector element is adapted to mate with any corresponding second connector elements and the power supply is in the first mode and a second position in which the first connector element is only adapted to mate with specially configured second connector elements and the power supply is in the second mode.

According to another aspect of the present invention, an electrical device includes a power supply that is switchable between a first mode and a second mode, the power supply including a first connector element, the first connector element being one of a male and a female connector element for mating with a corresponding second connector element, the second connector element being one of a female and a male connector element, respectively, the power supply also including a guard member disposed on the first connector element, the guard member being movable between a first position in which the first connector element is adapted to mate with any corresponding second connector elements and the power supply is in the first mode and a second position in which the first connector element is only adapted to mate with specially configured second connector elements and the power supply is in the second mode, and electrical equipment powered through the power supply.

According to yet another aspect of the present invention, a connector element assembly includes a connector element, the connector element being one of a male and a female connector element for mating with a corresponding mating connector element, the mating connector element being one of a female and a male connector element, respectively, and a guard member disposed on the connector element, the guard member being movable between a first position in which the connector element is adapted to mate with any corresponding mating connector elements and a second position in which the connector element is only adapted to mate with specially configured mating connector elements.

According to still another aspect of the present invention, a connector element assembly includes a connector element, the connector element being one of a male and a female connector element for mating with a corresponding mating connector element, the mating connector element being one of a female and a male connector element, respectively, and a configuration on the connector element for cooperating with a guard member disposed on the mating connector element, the configuration permitting the connector element to mate with the mating connector element, the guard member preventing the mating connector element from mating with connector elements not having the configuration.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
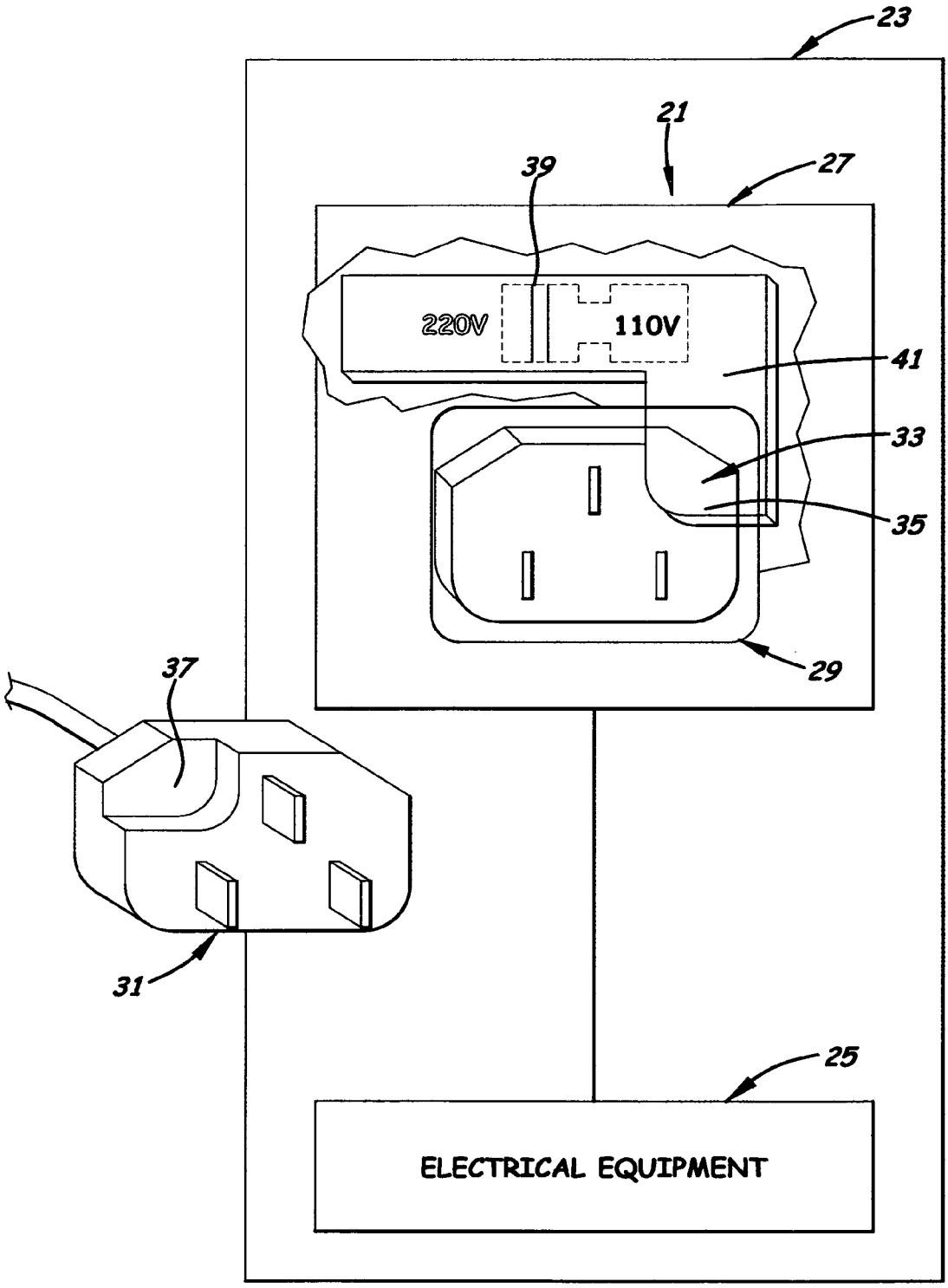
FIG. 1 is a schematic, partially perspective view of an electrical device with a power supply arrangement including connector elements according to an embodiment of the present invention.

A power supply arrangement 21 for an electrical device 23 is seen in FIG. 1. The electrical device 23 includes electrical equipment 25 that is powered through the power supply, such as the various components of a personal computer such as the digital circuits, disk drives, and fans.

The power supply arrangement 21 includes a power supply 27 that is switchable between a first mode and a second mode. The first mode may be, for example, a higher voltage, such as a 220V mode, and the second mode may be lower voltage, such as a 110V mode. The power supply arrangement 21 may include conventional circuitry (not shown) for automatically preventing damage to the power supply if it is set at a second, e.g., 110V, mode but plugged into a 220V power source, such as often occurs by accident. However, the power supply arrangement 21 need not include such protective circuitry.

The power supply arrangement 21 includes a first connector element 29 for the power supply 27. The first connector element 29 may be one of a male and a female connector element for mating with a corresponding second or mating connector element 31, the second connector element being the other type of connector, i.e., a female and a male connector element, respectively. For example, in conventional power supply arrangements, the first connector element is a female electrical socket and the second connector element is a power cord with a male plug end for mating with the female socket.

In the embodiments illustrated here, the first connector element 29 is a female element and the second connector element 31 is a male element. It will be appreciated that the first connector element 29 may be a female element and the second connector element 31 may be a male element. Additionally, the first and second connector elements do not necessarily have to be male or female elements.

The power supply arrangement 21 also includes a guard member 33 disposed on the first connector element 29. In the embodiment seen in FIG. 1, the guard member 33 is movable between a first position in which the first connector element 29 is adapted to mate with any corresponding second connector elements 31 and the power supply is in the first mode and a second position in which the first connector element is only adapted to mate with specially configured second connector elements and the power supply is in the second mode.

In the embodiment illustrated in FIG. 1, the specially configured second connector element 31 can be part of a 110V power cord while a second connector element 31*a* (FIG. 2C) that is not specially configured is part of a 220V power cord. By providing a special configuration for the second connector element 31 that is part of a 110V power cord, the inadvertent use of a 220V power cord that has no special configuration, like the second connector element 31*a*, cannot mate with the first connector element 29, thus reducing the risk of damaging the electrical device by providing power at too high of a voltage.

Figure 2A:
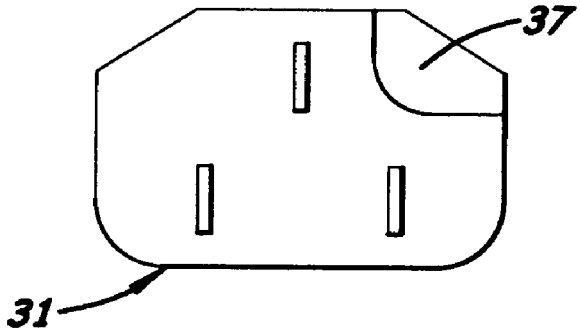
FIG. 2A is a plan view of a mating end of a male connector element including a recess.
Figure 2B:
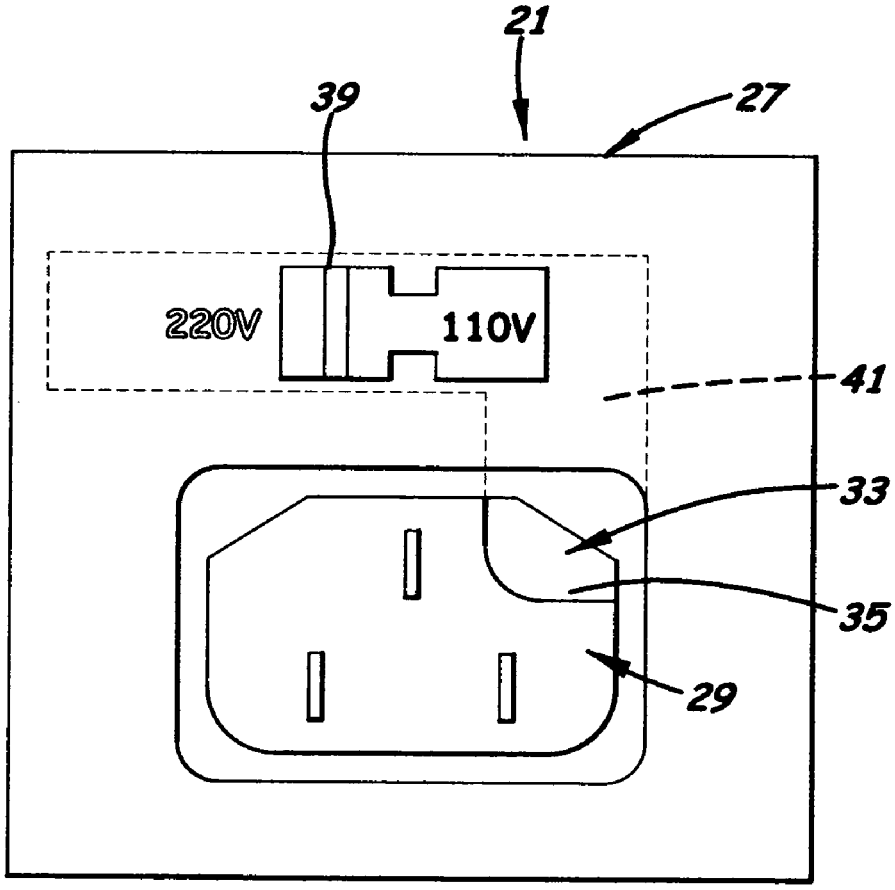
FIG. 2B is a plan view of a mating end of a female connector element including a guard in place to mate with a recessed male connector element of the type shown in FIG. 2A.
Figure 2C:
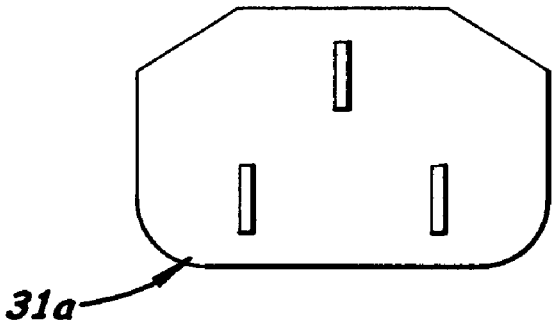
FIG. 2C is a plan view of a mating end of a male connector element that does not include a recess and is prevented from mating with a female connector element of the type shown in FIG. 2B.
Figure 2D:
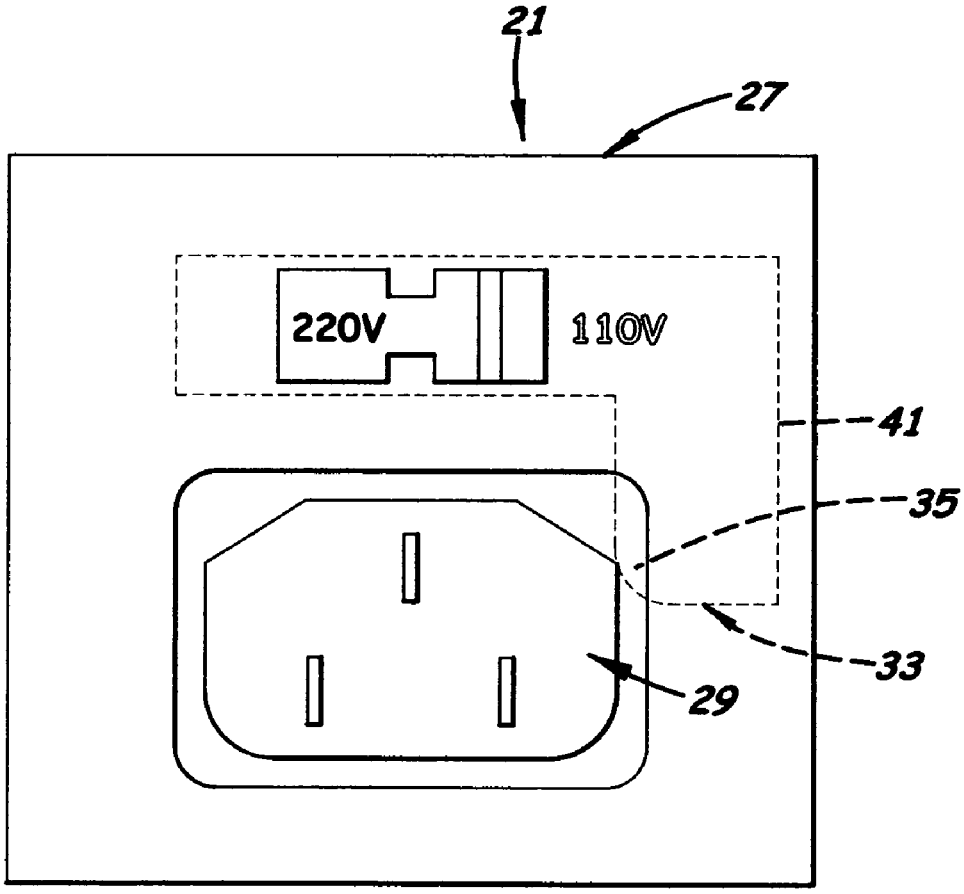
FIG. 2D is a plan view of a mating end of a female connector element not including a guard, the female connector element of FIG. 2D being adapted to mate with a recessed male connector element of the type shown in FIG. 2A and an unrecessed male connector of the type shown in FIG. 2C.

In the embodiment shown in FIG. 1, the guard member 33 includes a protrusion 35 that blocks a portion of the first connector element 29. The second connector element 31 can, in this case, be specially configured by providing a recessed area 37 to receive the protrusion 35. Thus, a second connector element 31 configured to include such a recessed area 37, as seen in FIG. 2A, can mate with the first connector element 29 when the guard member 33 blocks a portion of the first connector element of the type seen in FIG. 2B. A second connector element 31*a* that is not configured to include a recessed area as seen in FIG. 2C will be prevented from mating with the first connector element 29 by the guard member 33. When the guard member 33 is moved so that it does not block the portion of the first connector element 29, as seen in FIG. 2D, either the second connector element 31 shown in FIG. 2A or the second connector element 31*a* shown in FIG. 2B can mate with the first connector element.

As seen in FIG. 1, a switch 39 is provided for switching the power supply 27 between the first mode and the second mode, as in conventional power supplies. The guard member 33 may be coupled to the switch 39 by a variety of suitable means, such as by an arm 41 extending from the switch, by multi-component linkages, electromagnetically, or otherwise. The guard member 33 does not need to be coupled to the switch at all, however, when the switch 39 is moved between first and second switch positions corresponding to the first and second modes, the guard member 33 will also be moved between the first and the second positions. The guard member 33 may, of course, be moved by some means other than the switch 39, such as by a motor or piston device whose operation is controlled by the switch.

The invention is described here largely in connection with an application for power supplies. It will be appreciated that the invention has applications in a variety of other areas where it is occasionally desired or necessary to limit the types of connectors with which another connector can mate. For example, connectors that can be selectively prevented from mating with certain other connectors may be useful in mechanical structures. Connectors according to the present invention might, for example, be used to ensure that only specially adapted load bearing members such as cables capable of bearing particular weights are connected to connection points of an object to be borne while a more extensive array of cables can be connected to connection points of another, less heavy object.

While this invention has been illustrated and described in accordance with a preferred embodiment, it is recognized that variations and changes may be made therein without departing from the invention as set forth in the claims.

What is claimed is:

1. A power supply arrangement for an electrical device, comprising:

a power supply that is switchable between a first mode and a second mode;

a first connector element of the power supply, the first connector element being one of a male and a female connector element for mating with a corresponding second connector element, the second connector element being one of a female and a male connector element, respectively; and a guard member disposed on the first connector element, the guard member being movable between a first position in which the first connector element is adapted to mate with any corresponding second connector elements and the power supply is in the first mode and a second position in which the first connector element is only adapted to mate with specially configured second connector elements and the power supply is in the second mode.

2. The power supply arrangement as set forth in claim 1, further comprising a switch for switching the power supply between the first mode and the second mode, the guard member being movable between the first and the second positions upon moving the switch between first and second switch positions corresponding to the first and second modes.

3. The power supply arrangement as set forth in claim 2, wherein the guard member includes a protrusion that blocks a portion of the first connector element.

4. The power supply arrangement as set forth in claim 3, wherein the first connector element includes a female connector element and the second connector element includes a male connector element, and wherein the second connector element is specially configured by providing a recessed area to receive the protrusion.

5. The power supply arrangement as set forth in claim 3, wherein the first connector element includes a male connector element and the second connector element includes a female connector element, and wherein the second connector element is specially configured by providing a recessed area to receive the protrusion.

6. The power supply arrangement as set forth in claim 1, wherein the guard member includes a protrusion that blocks a portion of the first connector element.

7. The power supply arrangement as set forth in claim 1, wherein the first mode is a 220V mode, and the second mode is a 110V mode.

8. The power supply arrangement as set forth in claim 7, wherein the specially configured second connector element includes a 110V power cord.

9. The power supply arrangement as set forth in claim 8, wherein the guard member includes a protrusion that blocks a portion of the first connector element.

10. The power supply arrangement as set forth in claim 9, wherein the second connector element is specially configured by providing a recessed area to receive the protrusion.

11. The power supply arrangement as set forth in claim 1, wherein the first mode is a first voltage mode, and the second mode is a second voltage mode lower than the first voltage mode.

12. The power supply arrangement as set forth in claim 11, wherein the specially configured second connector element includes a power cord for use at the voltage of the second voltage mode.

13. The power supply arrangement as set forth in claim 1, wherein the second position of the guard member is characterized by a portion of the guard member engaging the second connector element when the first connector element and the second connector element are in a mated condition, and the first position of the guard member is characterized by the guard member being free of any engagement with the second connector element when the first connector element and the second connector element are in a mated condition.

14. The power supply arrangement as set forth in claim 1, wherein the guard member is movable in a substantially linear movement between the first position and the second position.

15. The power supply arrangement as set forth in claim 1, wherein the guard member is slidable between the first position and the second position.

16. The power supply arrangement as set forth in claim 1, additionally comprising a switch having a ridge extending outwardly for being engaged by fingers of a user to move the guard member.

17. The power supply arrangement as set forth in claim 1, wherein the first connector element defines a socket, and wherein the guard member reduces an area of the socket when the guard member is moved from the first position to the second position.

18. An electrical device, comprising:

a power supply that is switchable between a first mode and a second mode, the power supply including:

a first connector element, the first connector element being a female connector element defining a socket;

a corresponding second connector element, the second connector element being a male connector element for being removably insertable into the socket of the female connector element for mating with the first connector element; and a guard member disposed on the first connector element, the guard member being movable between a first position in which the first connector element is adapted to mate with any corresponding second connector elements and the power supply is in the first mode and a second position in which the first connector element is only adapted to mate with specially configured second connector elements and the power supply is in the second mode;

wherein at least a portion of the guard member extends into the socket of the first connector element when the guard member is in the second position of the guard member and no portion of the guard member extends into the socket of the first connector element when the guard member is in the first position of the guard member; and electrical equipment powered through the power supply.

19. A connector element assembly, comprising:

a connector element, the connector element being one of a wale and a female connector element for mating with a corresponding mating connector element, the mating connector element being one of a female and a male connector element, respectively; and a guard member disposed on the connector element, the guard member being movable in a substantially linear movement between a first position in which the connector element is adapted to mate with any corresponding mating connector elements and a second position in which the connector element is only adapted to mate with specially configured mating connector elements.

20. The connector element assembly as set forth in claim 19, wherein the guard member is associated with a switch and is movable between the first and the second positions upon moving the switch between first and second switch positions.

21. The connector element assembly as set forth in claim 20, wherein the guard member includes a protrusion that blocks a portion of the connector element.

22. The connector element assembly as set forth in claim 21, wherein the connector element includes a female connector element and the mating connector element includes a male connector element, and wherein the mating connector element is specially configured by providing a recessed area to receive the protrusion.

23. The connector element assembly as set forth in claim 21, wherein the connector element includes a male connector element and the mating connector element includes a female connector element, and wherein the mating connector element is specially configured by providing a recessed area to receive the protrusion.

24. The connector element assembly as set forth in claim 19, wherein the guard member includes a protrusion that blocks a portion of the connector element.

25. A connector element assembly, comprising:

a connector element, the connector element being one of a male and a female connector element for mating with a corresponding mating connector element, the mating connector element being one of a female and a male connector element, respectively; and a configuration on the connector element for cooperating with a guard member disposed on the mating connector element, the configuration permitting the connector element to mate with the mating connector element, the guard member preventing the mating connector element from mating with connector elements not having the configuration;

wherein the guard member includes a protrusion that, when the guard member is in a blocking position, blocks a portion of the mating connector element to prevent the mating connector element from mating with connector elements not having the configuration, and wherein the protrusion, when the guard member is in a non-blocking position, does not block the portion of the mating connector element to permit the mating connector element to mate with connector elements not having the configuration.

26. The connector element assembly as set forth in claim 25, wherein the mating connector element includes a power cord.

27. The connector element assembly as set forth in claim 25, wherein the configuration includes a recess.

* * * * *